US006056683A

United States Patent [19]

Reider

[11] Patent Number: 6,056,683

[45] Date of Patent: May 2, 2000

[54] ACTIVE STACKING SYSTEM

[75] Inventor: Robert Reider, Longmont, Colo.

[73] Assignee: Pentax Technologies Corporation, Broomfield, Colo.

[21] Appl. No.: 08/907,615

[22] Filed: Aug. 8, 1997

Related U.S. Application Data

[63] Continuation of application No. 08/550,398, Oct. 30, 1995, abandoned.

[51] Int. Cl.[7] ..... B65H 45/20

[52] U.S. Cl. ..... 493/410; 493/411; 493/413

[58] Field of Search ..... 493/409–415; 270/39.05, 58.28; 271/214, 215, 217; 414/789.1, 794.8, 926

[56] References Cited

U.S. PATENT DOCUMENTS

| | | | |
|---|---|---|---|
| 1,694,638 | 12/1928 | Borrowdale . | |
| 2,181,995 | 12/1939 | Keil . | |
| 3,149,836 | 9/1964 | Ragozzino et al. . | |
| 3,355,164 | 11/1967 | Stulman | 493/413 |
| 3,784,188 | 1/1974 | De Ligt . | |
| 3,889,824 | 6/1975 | Wood . | |
| 3,907,281 | 9/1975 | McKenzie . | |
| 4,095,779 | 6/1978 | Imagi et al. . | |
| 4,172,592 | 10/1979 | Müeller et al. | 493/413 |
| 4,460,169 | 7/1984 | Bartasagi | 271/217 |
| 4,508,527 | 4/1985 | Uno et al. . | |
| 4,512,561 | 4/1985 | Ury . | |
| 4,530,689 | 7/1985 | Ringer, Sr. . | |
| 4,577,853 | 3/1986 | Duke | 271/217 |
| 4,586,703 | 5/1986 | McAnelly . | |
| 4,697,804 | 10/1987 | Pollich . | |
| 4,718,807 | 1/1988 | Baxter | 414/794.8 |
| 4,750,724 | 6/1988 | Herd et al. . | |
| 4,811,688 | 3/1989 | Turner . | |
| 4,838,848 | 6/1989 | Lenzi | 493/414 |
| 4,842,573 | 6/1989 | Peter et al. . | |
| 4,934,687 | 6/1990 | Hayden et al. | 271/217 |
| 4,941,654 | 7/1990 | Kelley . | |
| 5,029,828 | 7/1991 | Sato et al. . | |
| 5,058,872 | 10/1991 | Gladow . | |
| 5,062,597 | 11/1991 | Martin et al. | 493/410 |
| 5,074,837 | 12/1991 | Blanton, III et al. | 493/410 |
| 5,110,101 | 5/1992 | Roth | 493/410 |
| 5,123,894 | 6/1992 | Bergeman et al. | 493/410 |
| 5,152,514 | 10/1992 | Meetze . | |
| 5,190,281 | 3/1993 | Cardenas | 271/217 |
| 5,226,742 | 7/1993 | Pintar et al. . | |
| 5,238,316 | 8/1993 | Moore et al. | 493/410 |
| 5,248,291 | 9/1993 | Denoon et al. . | |
| 5,279,536 | 1/1994 | Abreu | 493/410 |
| 5,300,608 | 4/1994 | Lee et al. | 493/410 |
| 5,321,464 | 6/1994 | Jessen et al. | 493/410 |
| 5,350,246 | 9/1994 | Sehringer | 493/410 |
| 5,364,334 | 11/1994 | Inomata | 493/410 |
| 5,425,694 | 6/1995 | Negishi . | |
| 5,513,921 | 5/1996 | Alcoran . | |

FOREIGN PATENT DOCUMENTS

| | | |
|---|---|---|
| 2316686 | 10/1973 | Germany . |
| 5250818 | 11/1977 | Japan . |
| 53-125127 | 11/1978 | Japan . |
| 5566456 | 5/1980 | Japan . |
| 5661271 | 5/1981 | Japan . |
| 597672 | 1/1984 | Japan . |
| 62-31665 | 2/1987 | Japan . |
| 1215558 | 12/1970 | United Kingdom . |
| 1288218 | 9/1972 | United Kingdom . |

*Primary Examiner*—Michael J. Carone
*Assistant Examiner*—Darren Ark
*Attorney, Agent, or Firm*—Greenblum & Bernstein, P.L.C.

[57] ABSTRACT

An active stacker which accepts paper through a formed wire guide at the top thereof. The wire guide directs the paper into a drive roller and idler set which pulls the paper from the printer and drives the paper downward so that it drops at about the center of the stack. The paper stacks on a horizontal tray which drops as the weight of the paper thereon increases, so that the top of the accumulated paper stack maintains a substantially constant position. The edges of the paper are packed by fingers which move vertically downward to the ends of the stack. One or more edge or side guides may be provided to prevent the stack from skewing sideways as it builds.

48 Claims, 13 Drawing Sheets

ACTIVE STACKING SYSTEM

This application is a continuation of application Ser. No. 08/550,398, filed Oct. 30, 1995, now abandoned.

BACKGROUND OF THE INVENTION

1. Field of the Invention

The invention concerns an apparatus which actively refolds and stacks continuous form paper which is outputted from a printer or other device which uses continuous form paper.

2. Description of Background Information

Refolding and stacking of continuous form paper is often accomplished by passive gravity fed stackers, which may take the form of a wire basket or other box shaped configuration. However, problems often arise with these types of stackers, since continuous form papers have a tendency to mis-stack or mis-fold over the course of stacking large numbers of sheets of the same. A mis-stack is defined as any media movement in the stacker that results in a fatal printer fault (i.e., the printer halts), causes the media to overflow the stacker, or requires operator intervention. A mis-fold is defined as abnormal media handling in the stacker that allows printing and stacking to continue and does not result in paper jams, fatal printer faults, or stacker overflow.

With the advent and commonplace use of laser printers, occurrences of mis-stacks and mis-folds have been exacerbated. The heat pressure rollers that the laser printer uses to fuse the toner image onto the printer paper tend to iron out the perforations between the sheets of the continuous form paper. As a result, the paper folds lose their memory and have a tendency not to easily refold into a neat stack. As printer speeds have improved over time, the occurrences of mis-folds and mis-stacks have further increased.

Various stackers, both active and passive, have been developed to address the above problems. Analog Technology Corp. has developed a stacker which consists of a wire-form paper guide for receiving the paper at the printer exit, a passive spring supported elevator stacker assembly incorporated into a printer stand, and a small module containing two motor-driven tractor belts. The motor driven tractor belts pull down only the weak side perforations (where face stocks are opposed) to improve the stacking operation.

DeNoon et al., U.S. Pat. No. 5,248,291, discloses an apparatus which utilizes a rotating beater brush to partially lessen the stiffness at the fold lines of the paper exiting a printer. The paper then moves downward toward a stacking support between paddle towers. The towers each contain a continuous belt of hinged paddles which urge the paper into folds.

SUMMARY OF THE INVENTION

The present invention solves the above problems by providing an active stacker which accepts paper through a formed wire guide at the top thereof. In a preferred embodiment, the wire guide directs the paper into a drive roller and idler set which pulls the paper from the printer and drives the paper downward so that it drops at about the center of the stack.

The paper stacks on a horizontal tray which drops as the weight of the paper thereon increases, so that the top of the accumulated paper stack maintains a substantially constant position. The edges of the paper are packed by fingers which move vertically downward to the ends of the stack. One or more edge guides may be provided to prevent the stack from skewing sideways as it builds.

Other objects and advantages of the present invention and advantageous features thereof will become apparent as the description proceeds herein.

Included in the description is an active stacking system for continuous form paper, comprising a base for supporting the system; first and second generally vertical support assemblies extending from the base; a generally horizontal support assembly extending between the first and second vertical supports for stacking the continuous form paper thereon, the horizontal support being mounted to the first vertical support for vertical movement with respect thereto; a finger drive assembly pivotally mounted to one of the first and second vertical supports and extending in a vertical direction therealong; a continuous belt rotatably driven by the finger drive assembly; a motor for driving the finger drive assembly and the continuous belt; and fingers extending from the continuous belt and intermittently spaced therealong, for contacting edges of the continuous form paper and packing the same into a substantially uniform stack. The finger drive assembly is pivotable outwardly from the vertical support to which it is fixed, to allow access to the paper on the horizontal support.

The active stacking system further includes a housing mounted above the vertical supports; a tensioning mechanism in the housing, for resiliently supporting the horizontal support; and interconnecting means for interconnecting the tensioning mechanism and the horizontal support. The horizontal support moves vertically downward as weight is accumulated thereon, and the tensioning mechanism maintains positioning of the horizontal support so as to maintain a top of the paper stack in a substantially constant vertical position. The tensioning mechanism preferably comprises a torsion spring (e.g., a garage door opener spring) and the interconnecting means preferably comprises a cable.

A second finger assembly drive is preferably pivotally mounted to the other of the first and second vertical supports and extending in a vertical direction therealong, so as to provide a pair of finger drive assemblies on opposite side edges of the continuous form paper as it is fed through the stacker. A second continuous belt is rotatably driven by the second finger drive assembly. A second motor drives the second finger drive assembly and the second continuous belt. Second fingers extend from the second continuous belt and are intermittently spaced therealong, for contacting edges of the continuous form paper and packing the same into a substantially uniform stack. The second finger drive assembly is preferably also pivotable away from the vertical support to which it is mounted, to allow access to the paper on the horizontal support.

In a preferred embodiment, a drive roller mechanism is mounted transversely on the housing, and a third motor is connected to the drive roller mechanism for driving the drive roller mechanism. A guide is pivotally mounted to the housing, and is pivotable toward and away from the drive roller mechanism. A pressure roller is mounted transversely on the guide, such that, upon pivoting the guide toward the drive roller mechanism, the pressure roller applies pressure to the drive roller mechanism to provide a nip through which the continuous paper is driven.

Preferably, the drive roller mechanism comprises two axially aligned rollers, each being driven by the third motor.

The horizontal support further includes a rib mounted transversely or longitudinally on a top side and centrally thereof, to raise a middle portion of the stacked paper to compensate for a tendency of the paper to stack more compactly in the middle of the stack than at the edges.

The active stacking system according to the present invention further preferably includes at least one side guide pivotally mounted to one of the first and second vertical supports, and pivotable between an active position, in which the at least one side guide maintains alignment of a side edge of the paper as it stacks upon the horizontal support, and an inactive position, in which the at least one side guide is pivoted away from the active position to allow side access to the stacked paper.

The at least one side guide is mounted on a rod connected transversely to one of the first and second vertical supports. When first and second side guides are provided, they are pivotally mounted near opposite ends of the rod, wherein each of the first and second side guides are pivotable between active and inactive positions.

The first generally vertical support assembly further preferably includes a pair of generally vertically extending opposed tracks and generally vertically extending wire guides positioned between the vertically extending opposed tracks. The horizontal support includes a pair of rolling supports for rolling within the pair of vertically extending opposed tracks for generally vertical movement of the horizontal support.

The second generally vertical support assembly preferably includes generally vertically extending wire guides adjustably positioned with respect to the first vertical support to accommodate different sheet lengths of the continuous form paper.

The horizontal support preferably includes generally horizontally extending wire guides which extend between the vertically extending wire guides of the second vertical support to allow adjustable positioning of the first vertical support therealong.

In one embodiment, a relay is connected to at least one motor of the stacker, for supplying power to the motor when the relay is connected to a printer, wherein the printer activates the relay to activate the motor during printing. Most preferably, the relay is mounted in the housing and connected to the first, second and third motors for supplying power thereto when a print signal is outputted by the printer. Alternatively, a power switch for activating the active stacking system independently of a printer may be provided.

A second generally horizontal support may be mounted atop the first generally vertical support and extends generally horizontally away from the second generally vertical support. The second horizontal support is adapted to support a printer, such that paper output from the printer is fed into the active stacking system.

A pair of swinging arms may be pivotally mounted to swing beneath the housing, wherein the continuous form paper is guided between the pair of swinging arms. The swinging arms direct the continuous form paper toward a central position of the horizontal support.

Still further, an upper guide may be pivotally mounted to the housing, to extend above a top surface of an associated printer. The upper guide is pivotable toward the printer to rest thereupon, and away from the printer to allow access to the printer.

In another embodiment, the active stacking system according to the present invention includes an angular drive assembly extending angularly from the finger drive assembly into a path of the continuous form paper. The angular drive assembly is driven by the finger drive assembly to contact the continuous form paper and pull the continuous form paper toward the finger drive assembly.

An active stacking system for continuous form paper according to the present invention preferably includes a base for supporting the system; first and second generally vertical supports extending from the base; a generally horizontal support extending between the first and second vertical supports for stacking the continuous form paper thereon, with the horizontal support being mounted to the first vertical support for generally vertical movement with respect thereto; a finger drive assembly mounted to one of the first and second vertical support assemblies and extending in a vertical direction therealong, with the finger drive assembly comprising movable fingers for contacting edges of the continuous form paper and packing the same into a substantially uniform stack; a drive roller mechanism mounted transversely on the housing; a drive roller motor connected to the drive roller mechanism for driving the drive roller mechanism independently of the finger drive assembly; a guide pivotally mounted to the housing, and being pivotable toward and away from the drive roller mechanism; and a pressure roller mounted transversely on the guide. Upon pivoting the guide toward the drive roller mechanism, the pressure roller applies pressure to the drive roller mechanism to provide a nip through which the continuous paper is driven.

A second finger drive assembly may be pivotally mounted to the other of the first and second vertical support assemblies, to extend in a substantially vertical direction therealong. First and second continuous belts are rotatably driven by the first and second finger drive assemblies. First and second motors independently drive the first and second finger drive assemblies and the first and second continuous belts. Fingers extend from each of the first and second continuous belts and are intermittently spaced therealong, for contacting opposite side edges of the continuous form paper and packing the same into a substantially uniform stack. At least one of the finger drives is pivotable away from one of the first and second vertical support assemblies to allow access to the paper on the horizontal support.

A housing, mounted above the vertical supports, houses a tensioning mechanism for resiliently supporting the horizontal support. Interconnecting means interconnect the tensioning mechanism and the horizontal support. The horizontal support moves generally vertically downward as weight is accumulated thereon, and the tensioning mechanism maintains positioning of the horizontal support so as to maintain a top of the paper stack in a substantially constant vertical position.

A rib mounted on a top side and centrally of the horizontal support raises a middle portion of the stacked paper to compensate for a tendency of the paper to stack more compactly in the middle of the stack than at the edges. A rod is mounted transversely on one of the first and second vertical supports, and first and second side guides are pivotally mounted near opposite ends of the rod. The first and second side guides are each pivotable between an active position, in which each side guide maintains alignment of a side edge of the paper as it stacks upon the horizontal support, and an inactive position, in which each side guide is pivoted away from the active position to allow side access to the stacked paper.

The first generally vertical support assembly preferably comprises a pair of generally vertically extending opposed tracks and generally vertically extending wire guides positioned between the vertically extending opposed tracks. The horizontal support preferably comprises a pair of rolling supports for rolling within the pair of vertically extending opposed tracks for vertical movement of the horizontal support. The second vertical support preferably comprises vertically extending wire guides adjustably positioned with respect to the first vertical support to accommodate different sheet lengths of the continuous form paper. The horizontal support further preferably comprises generally horizontally extending wire guides which extend between the vertically extending wire guides of the second vertical support to allow the adjustable positioning of the first vertical support therealong.

BRIEF DESCRIPTION OF THE DRAWINGS

The present invention is further explained in the description which follows with reference to the drawings, illustrating, by way of non-limiting examples, various embodiments of the invention, with like reference numerals representing similar parts throughout the several views, and wherein.

DESCRIPTION OF THE PREFERRED EMBODIMENTS

Figure 1:
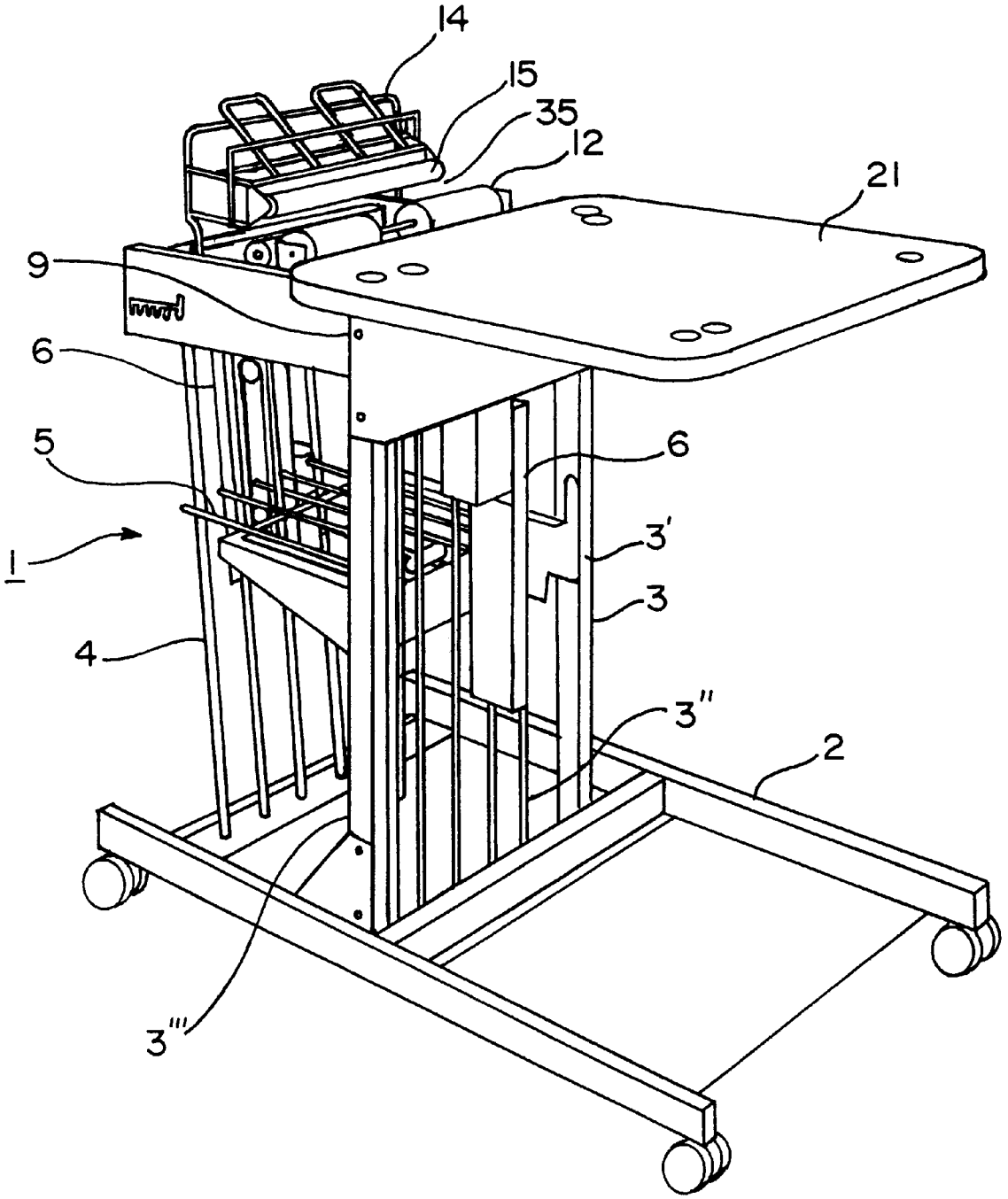
FIG. 1 is a perspective view of a first embodiment of the active stacker system according to the present invention.
Figure 2:
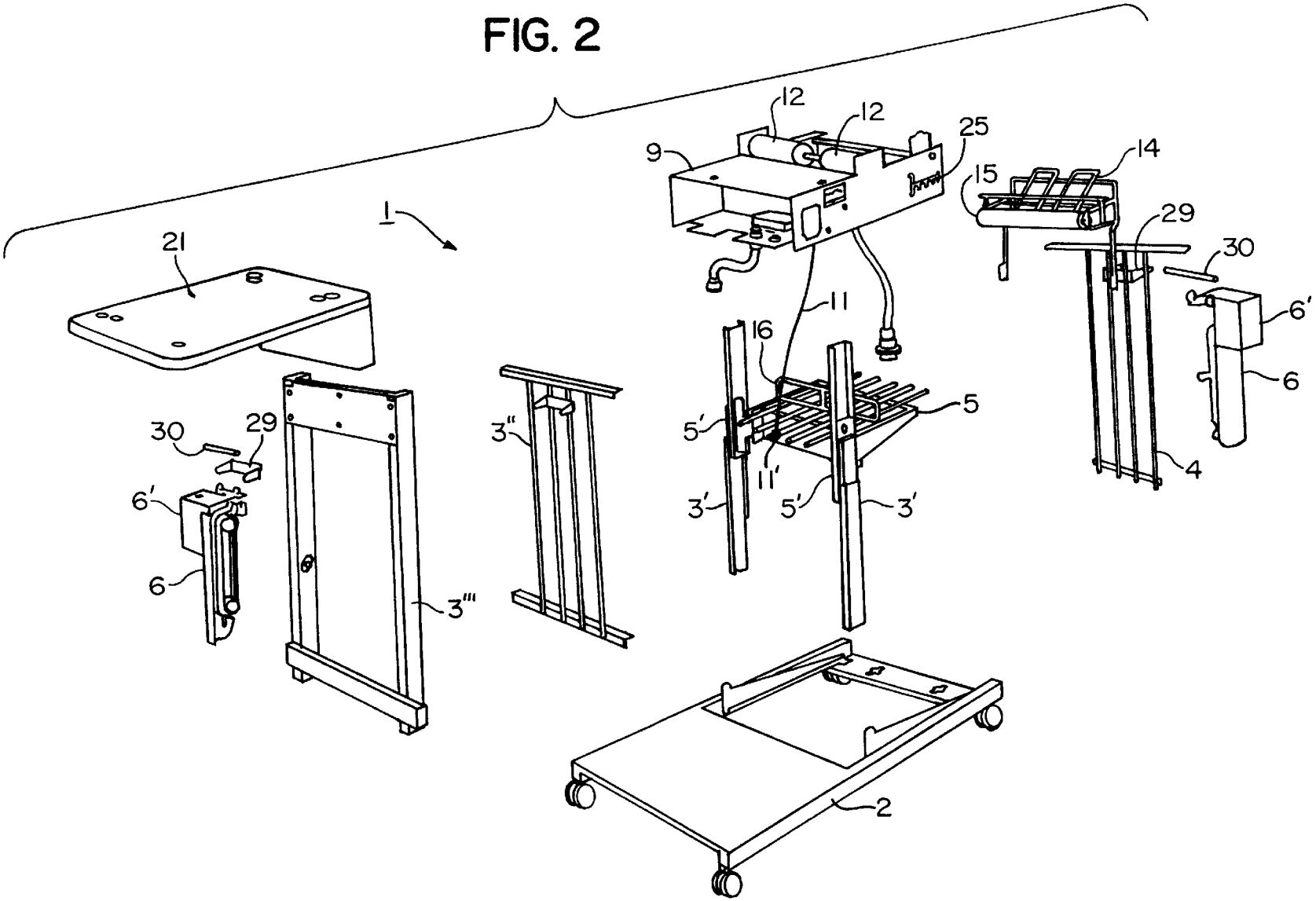
FIG. 2 is an exploded view of the embodiment shown in FIG. 1.

Referring now to the drawings in detail, FIG. 1 shows a preferred embodiment of the active stacking system according to the present invention. The stacker 1 includes a guide 14 which guides continuous form paper exiting a printer and directs the paper between a drive roller mechanism 12 and a pressure roller 15. Guide 14 is preferably a wire guide which is pivotally mounted to housing 9. Drive roller mechanism 12 is mounted transversely on the housing 9 adjacent a covered portion of the housing 9 as shown in FIG. 2.

Guide 14 is pivotable toward and away from the drive roller mechanism 12. FIG. 1 shows the guide 14 pivoted away from the drive roller mechanism. A pressure roller 15 is transversely mounted on the guide 14 and is adapted to press against the drive roller mechanism 12 to form a nip 36 through which the continuous form paper is fed. When guide 14 is pivoted away from the drive roller mechanism, the pressure roller 15 is thereby separated from contact with the drive roller mechanism as shown in FIG. 1, permitting free access to the continuous form paper.

The embodiment shown in FIG. 1 includes a second horizontal support 21 which is preferably a table surface that extends from its mounted position above vertical support 3, in a horizontal direction away from vertical support 4. Table 21 is provided to support a printer, such that continuous paper output therefrom can be directly fed into the stacker system. Alternatively, the stacker system shown in FIG. 1 is also provided in an embodiment without the table 21, as a stand alone stacker system, which allows it to be positioned behind printers that have built in pedestals. Other than the table, this embodiment is functionally equivalent to that previously described.

Figure 10:
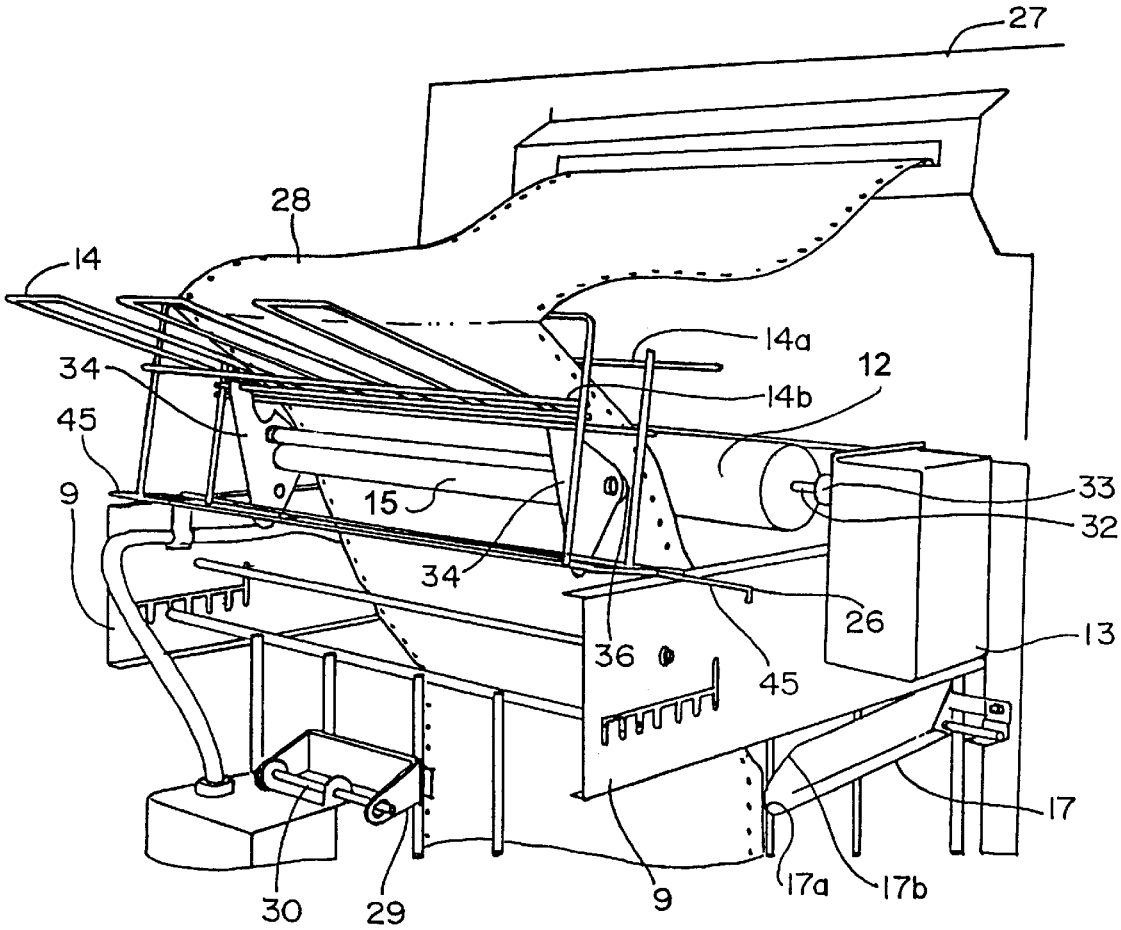
FIG. 10 is a perspective view of the guide, pressure roller and drive roller mechanism according to one embodiment of the present invention.

FIG. 10 shows the operation of the guide 14, pressure roller 15 and drive roller mechanism 12 in greater detail. Guide 14 is provided with a pair of peripheral rods 45 which extend peripherally along the housing 9 and insert into holes 26 provided in the sides of housing 9, thereby pivotally mounting guide 14 with respect to housing 9. The peripheral rods each have a terminal bend formed at approximately a 90 degree angle to the remainder of the rod, for insertion into the respective holes 26.

Mounting of the guide 14 to housing 9 is performed by elastically deforming the terminal ends of peripheral rods 45 away from one another so as to form a distance therebetween to allow the guide 14 to be positioned over the housing 9. The terminal ends are then released from the deforming force, whereby they elastically return to their original positions, at which time the terminal ends insert into holes 26. Thereafter, the terminal rods 45 (and the remainder of guide 14 which is integrally connected to rods 45) are freely pivotal about the holes 26.

Drive roller mechanism 12 is mounted transversely on the housing 9 via shaft 32, which is rotatably supported on bushings 33. One bushing is mounted to a fixed support extending from housing 9 and the other is directly driven by motor 13. Pressure roller 15 is mounted to guide 14 via brackets 34 in a conventional manner.

Feeding of the continuous form paper into the active stacking system is performed as follows. As the continuous form paper 28 exits the printer 27, the leading edge thereof is threaded between guide rods 14*a* and 14*b* of guide 14, and fed through a gap 35 which exists between pressure roller 15 and drive roller mechanism 12, as guide 14 (and therefore pressure roller 15) are in the pivoted away position at this stage. Gap 35 is illustrated in FIG. 1. Next, the operator pivots the entire assembly of the guide 14 and pressure roller 15 to the operating position where pressure roller 15 contacts drive roller mechanism 12, with the continuous form paper passing through a nip 36 formed between pressure roller 15 and drive roller mechanism 12, as shown in FIG. 10.

Figure 5:
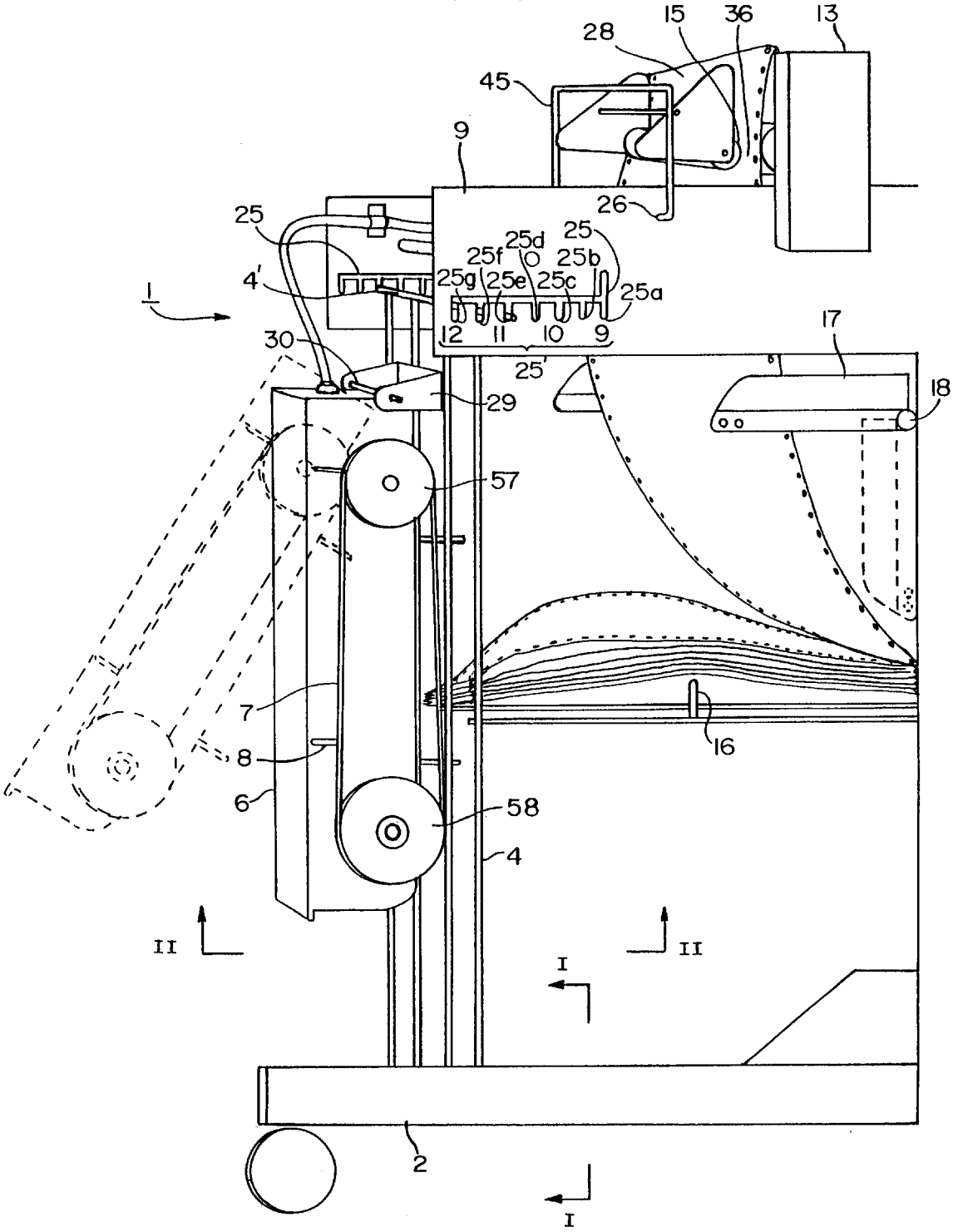
FIG. 5 is a side view of the embodiment shown in FIG. 1.

FIG. 5 shows the guide 14 in the position rotated toward the drive roller mechanism whereby the pressure roller 15 makes contact with the drive roller mechanism 12 to form a nip 36 for driving the continuous form paper 28. Motor 13 is connected to the drive roller mechanism 12 for driving the drive roller mechanism at a speed which translates to a paper feeding speed that is about 10% to 20% faster than the feeding speed of the associated printer. The weight of the pressure roller 15 applies sufficient force to maintain contact between the pressure roller 15 and the drive roller mechanism 12 when the guide 14 is in the position rotated toward the drive roller mechanism. The pressure exerted by the pressure roller 15 against the drive roller mechanism 12 to form the nip 36 is sufficient to drive the pressure roller via the driving force of the drive roller mechanism, and is also sufficient to exert a small pulling force on the continuous form paper to ensure that slack does not build up between the nip 36 and the printer 27.

However, the force is not sufficient to disturb the paper speed, which is controlled by the printer, and thus the pressure roller and drive roller mechanism continuously slip to a certain extent on the continuous form paper. The paper may also be pulled backward through the nip 36 by the printer while the drive roller mechanism and pressure roller are operating. Motor 13 is preferably a permanent magnet synchronous motor.

The continuous form paper 28 is fed through the nip 36 and driven downwardly so that the continuous form paper 28 drops substantially at the center of horizontal support assembly 5. Refolding of the continuous form paper must be started into the original orientation by hand, after which all subsequent stacking is automatic.

The active stacking system further includes first and second vertical support assemblies 3 and 4, which extend from base 2 and connect with housing 9. The first vertical support assembly 3 is located adjacent the intended printer location. The first vertical support assembly 3 preferably includes a pair of vertically extending opposed tracks 3' which fit within vertical structural support 3''', and vertically extending wire guides 3" positioned between and generally parallel to the vertically extending opposed tracks 3'. The horizontal support assembly 5 includes a pair of rolling supports 5' which interfit in the opposed tracks 3' to stabilize the horizontal support in its horizontal orientation. The rolling supports 5' also roll within the respective tracks 3' to allow vertical movement of the horizontal support.

Figure 6:
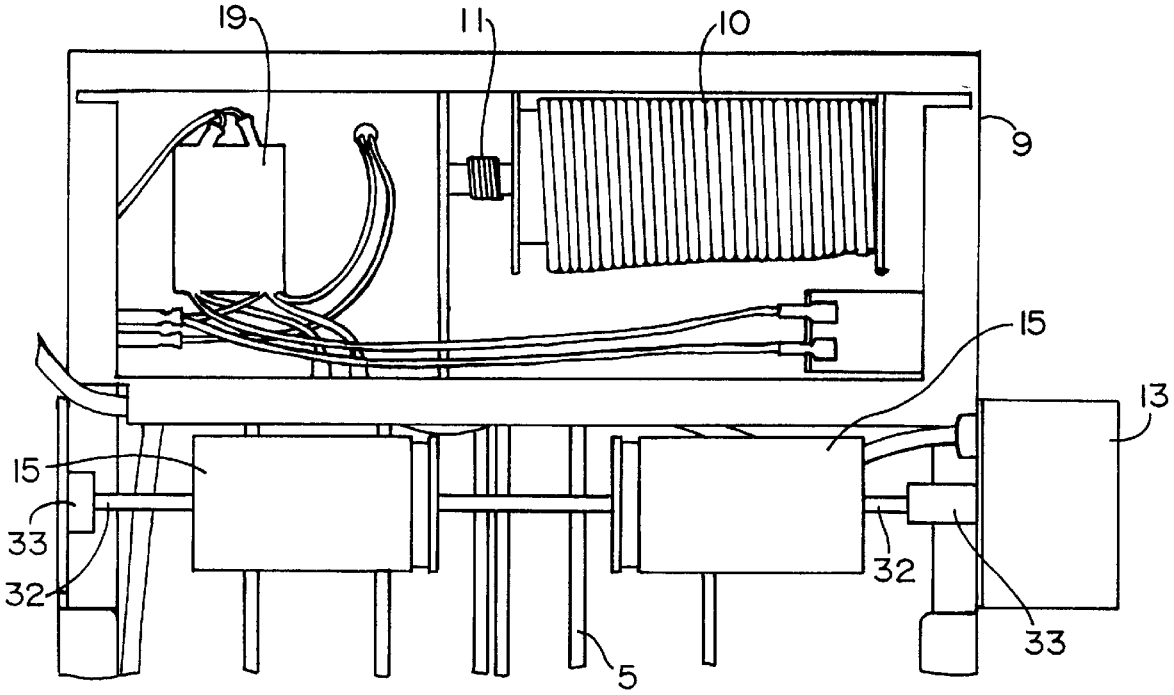
FIG. 6 is a top view of the covered section of housing 9, with the cover removed, and the adjacent drive roller mechanism.

Housing 9 is mounted atop the vertical supports 3 and 4, and further contains an enclosed portion which houses a tensioning mechanism 10 (see FIG. 6) which applies tension to interconnecting means 11. Interconnecting means 11 is connected at an end opposite the tensioning mechanism, to one of the horizontally extending rods of horizontal support 5, as shown in FIGS. 2, 4, 8 and 9. The tensioning mechanism is preferably a torsion spring (which can be, for example a spring substantially the same as that used in a garage door opener) mounted transversely in the housing 9 as shown in FIG. 6, but other equivalent tensioning mechanisms may be substituted therefor. Interconnecting means 11 is preferably a cable, but may also be a chain, wire or other equivalent structure. The interconnecting means shown in FIG. 2, includes a loop 11' at the end thereof, which is slipped over the end of a central rod of horizontal support assembly 5 for support thereof.

The spring constant value of tensioning mechanism 10 is set so that the horizontal support 5 will drop as the weight of the paper which accumulates thereon increases. The spring constant is such that the distance that the horizontal support drops is substantially equal to the height of the paper stack which accumulates thereon. Accordingly, the top of the paper stack remains in a substantially constant position, thereby improving the consistency of any stacking operation.

Rib 16 is mounted on the top side and centrally of the horizontal support to raise a middle portion of the stacked paper to compensate for a tendency of the paper to stack more compactly in the middle of the stack than at the edges. As shown in FIG. 2, rib 16 is preferably mounted transversely and generally vertically on horizontal support 5. However, rib 16 may alternatively be mounted longitudinally on the top side, and centrally of horizontal support 5.

The vertically extending wire guides 3" provide a boundary for one end of the continuous form paper stack and maintain alignment of the end of the continuous form paper stack along the end nearer the printer. The second vertical support 4 also includes vertically extending wire guides which provide a boundary for the other end of the continuous form paper stack and maintain alignment of the other end. The vertically extending wire guides of the second vertical support 4 are adjustably positionable within the housing 9 and base 2. The horizontal support 5 further includes horizontally extending wire guides which extend from an end at which the pair of rolling supports 5' are located to ends which interlink with the vertically extending wire guides 4" of vertical support assembly 4.

Transverse rod 4' is fixed across the top ends of the vertically extending wire guides to connect the upstanding rods which form the unitary second vertical support 4. As shown in FIG. 5, equidistantly spaced slots 25 (25*a–g*) are provided on both sides of housing 9. The slots 25*a–g* are spaced at predefined distances of between 9" and 12" from first vertical support 3 at 0.5" increments. This allows transverse rod 4' to be adjustably positioned in any of the predefined pairs of slots to adjust the distance between supports 3 and 4, so as to accommodate different page lengths of continuous form paper. Although the preferred embodiment accommodates page lengths of 9" to 12" at 0.5" intervals, the invention is not intended to be limited to these page lengths, as additional slots could be provided to accommodate different page lengths. Preferably, indicia 25' are provided to assist in adjusting the vertical support assembly 4 to a desired page length. By adjusting the position of assembly 4 within housing 9 and base 2, the spacing between the two vertical assemblies 3 and 4 can be varied to accommodate different page lengths of continuous form paper.

Figure 7:
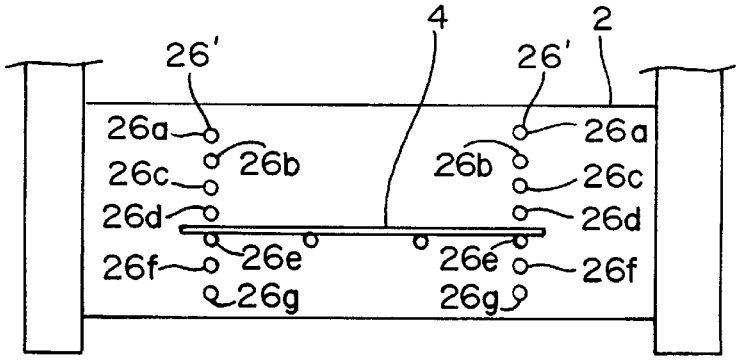
FIG. 7 is a sectional top view of FIG. 5, taken along the lines I—I and II—II.

As shown in FIG. 7, a transverse (generally horizontal) support of the base 2 includes generally parallel sets of holes 26' which are equidistantly spaced from the vertical support 3, at distances which correspond to the distances of the slots 25 from the vertical support 3 (i.e., 26*a*–26*g* correspond to 25*a*–25*g*, respectively). The bottom ends of the two outside vertically extending wire guides of support 4 insert into holes 26' to maintain the support 4 at a constant distance from support 3, from top to bottom. While it is noted that the bottom ends of the wire guides other than the two outside wire guides do not insert into holes 26', this is a preferred embodiment of the invention, and the invention is not to be limited to only this arrangement. Alternatively, the inside wire guides could be designed to insert into holes in addition to, or instead of, insertion of the outside wire guides into holes.

Adjustment of the vertical support is performed by a simple operation of lifting the transverse rod to remove the same from the slots 25. This action simultaneously frees the bottom ends of the wire guides from holes 26'. The entire vertical support can then be moved to the desired distance from the vertical support 3, at which time the bottom ends of the wire guides are reinserted into the appropriate holes 26'. Simultaneously, the transverse rod is cradled in the corresponding slots 25.

Turning now to the finger drive assembly 6, FIG. 5 shows an enlarged view detailing the same. The preferred embodiments employ a pair of finger drive assemblies 6, one mounted on vertical support 3 and one mounted on vertical support 4. However, alternate embodiments may use only one finger drive 6 mounted on either vertical support 3 or vertical support 4. Each finger drive 6 includes a body which supports first and second pulleys 57, 58 around which a continuous flat belt 7 is driven.

Extending outwardly from flat belt 7 are a plurality of flexible fingers 8, which extend into the path of the continuous form paper as they are being driven vertically downward. The fingers are preferably spaced along the belt at a distance between one and two average page lengths, so that a finger makes contact with the continuous paper often enough to assist in packing down each folded edge which occurs on the particular side of the stack which the finger drive is located. The fingers are preferably made of urethane, however, any other known equivalent materials which meet the flexibility and durability requirements for this purpose may be substituted.

Top pulley 57 is driven by motor 6', which in turn drives the belt 7, fingers 8 and bottom pulley 58. Motor 6' is preferably a permanent magnet synchronous motor which rotates at a constant speed of about 20 rpm. The driving speed of motor 6' translates to a driving speed of the fingers 8 which is slower than the feeding speed of the continuous form paper. Preferably, each finger drive assembly is independently driven by a respective motor 6'; but, alternatively, it would be possible to drive a pair of finger drive assemblies using a single drive motor.

The finger drive assemblies 6 are preferably pivotally fixed to the respective first and second vertical support assemblies. Each drive assembly 6 is fixed to respective vertical wire guides via a horizontally extending bracket 29 and pivot pin 30, as shown in FIGS. 2, 4, 5 and 10. As shown in phantom in FIG. 5, the finger drive assembly 6 is pivotable outwardly (i.e., away) from the vertical support 4. This allows the operator access to the end of the paper stack. Likewise, the finger drive assembly 6 on the opposite end is pivotable away from the vertical support assembly 3. This allows the operator access to the other end of the paper stack, and to access for other service procedures.

Figure 11:
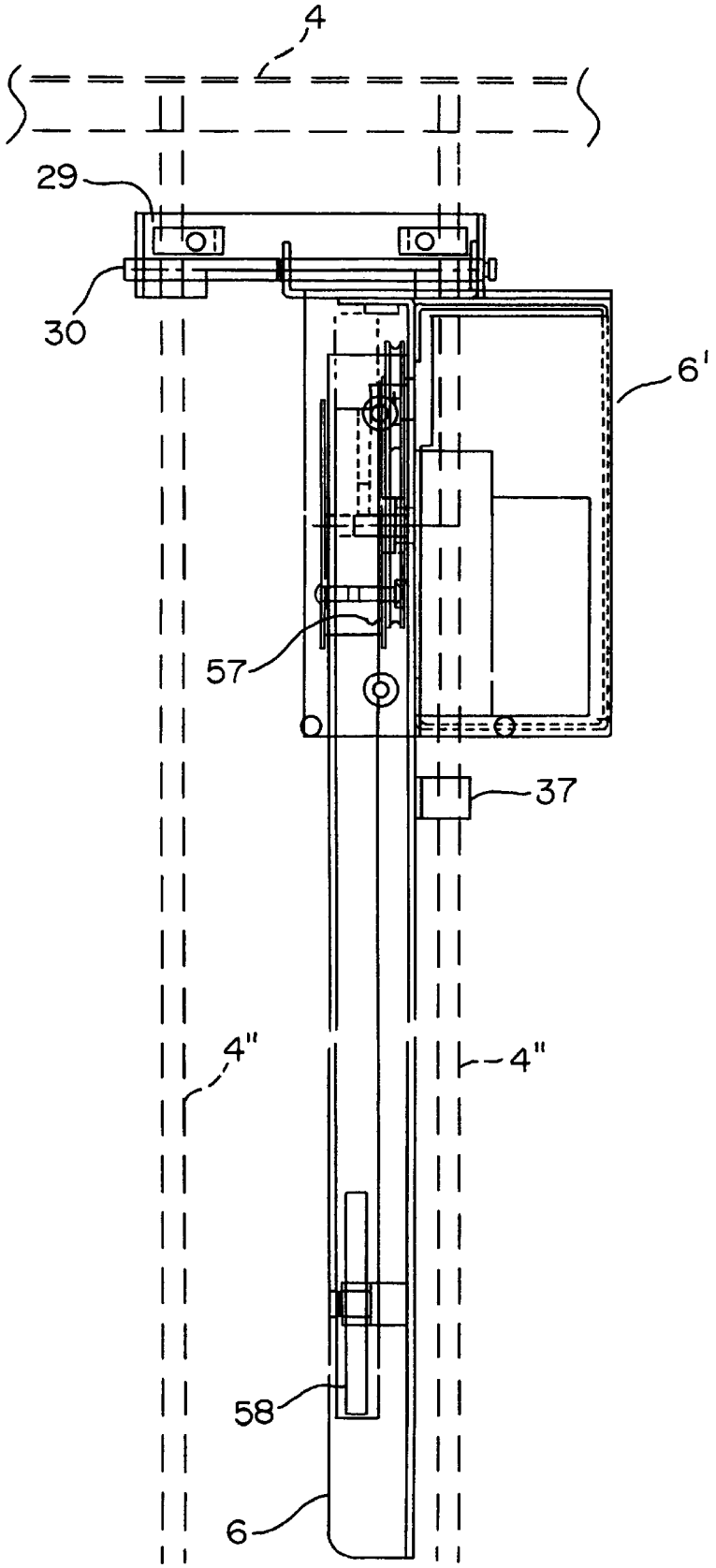
FIG. 11 is a front view of a finger drive assembly of the present invention.
Figure 12:
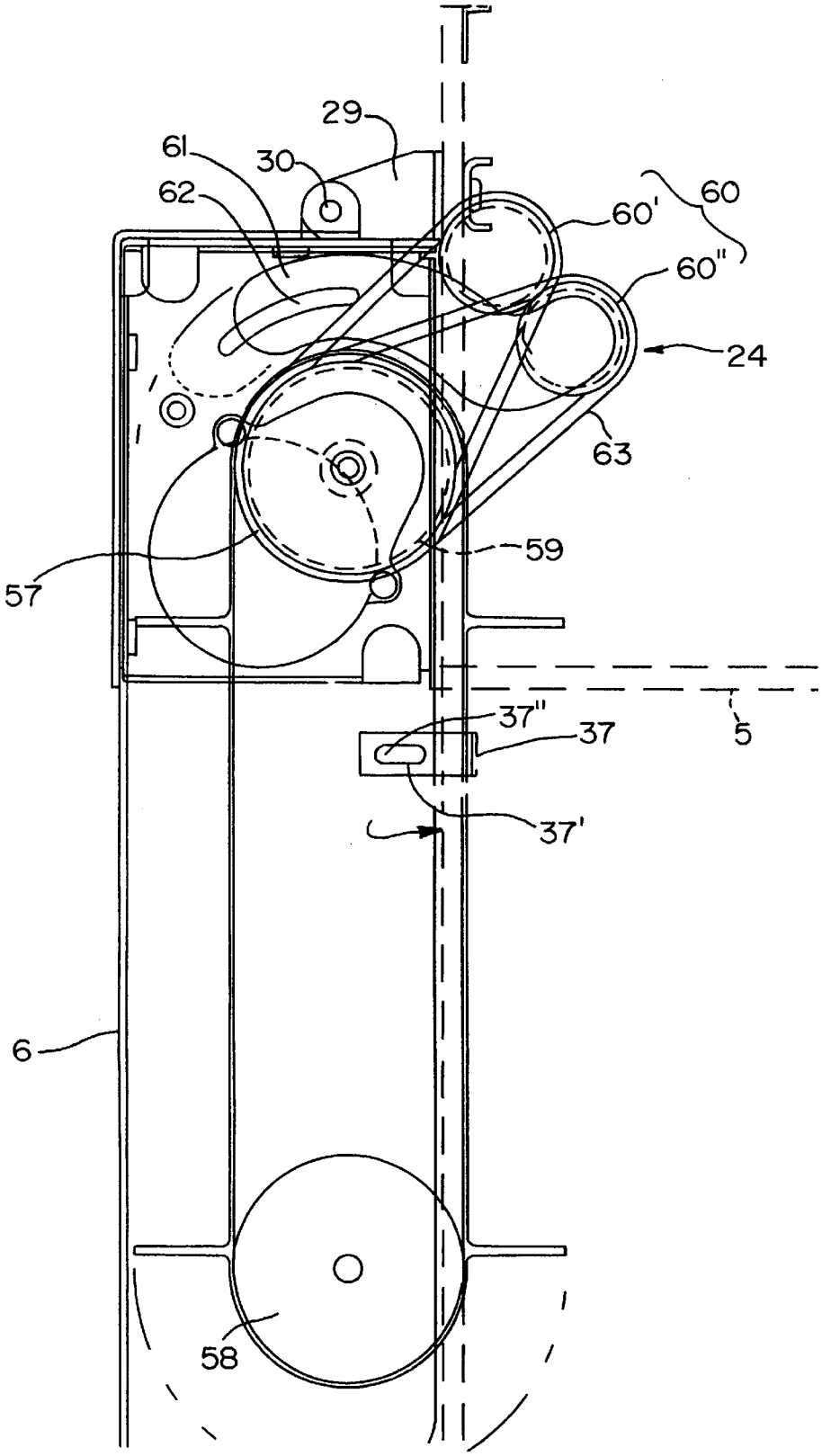
FIG. 12 is a side view of a finger drive assembly which includes an optional angular drive extending therefrom.

The weight of each individual finger drive assembly is sufficient to maintain it in its vertical operational position during operation of the stacking system, each assembly being freely pivotally mounted about respective pivot pins 30. Additionally, stop 37 is mounted to a side of each of the finger drive assemblies 6, as shown in FIGS. 11 and 12. Thus, when the operator releases the finger drive assembly from its outwardly pivoted position, the finger drive assembly, powered by gravitational forces acting upon the weight of the assembly, pivots back into the substantially vertical position against the vertically extending wire guides of the vertical support assembly. Stop 37 is preferably an ear-shaped bracket which includes an adjustment groove 37' so that the stopping distance of the edge of the finger drive assembly from the vertically extending wire guides can be adjusted (see FIG. 12). Stop 37 is preferably fixed to the side of finger drive assembly by a screw or bolt and nut assembly 37". However, it is noted that other shapes may be used to effect the stopping of the finger drive assembly against the vertically extending wire guides in an appropriate operative position, and it is further noted that other fixing means, such as a rivet or other equivalent, can be used to fix the stop 37 to finger drive assembly 6. Pulleys 57 and 58 extend beyond the vertical range at which the top of the stack of continuous form paper is located during stacking.

Additionally, the stacker system is preferably provided with a pair of side guides 17 which are adjustable to accommodate different widths of paper, and which form side boundaries for the continuous form paper as it is being fed through the stacker, to help prevent skewing to one side or another. Such skewing is a common occurrence when stacking continuous form paper and for this reason two side guides are preferred. However, alternative embodiments could be provided with only one side guide, and the present invention will function (although not as effectively), without the use of either of the side guides.

Figure 13:
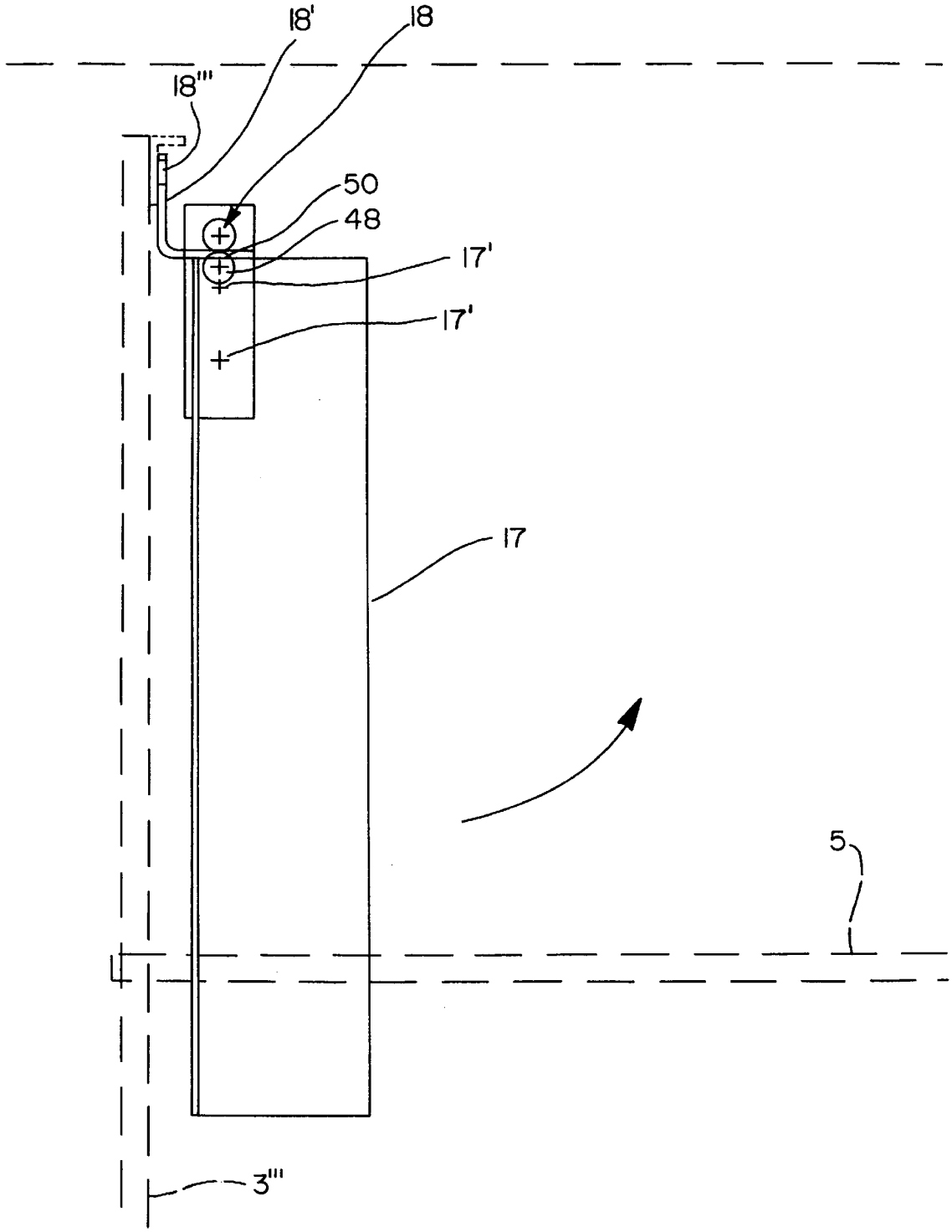
FIG. 13 is a side view of a side guide in an operative position.
Figure 15:
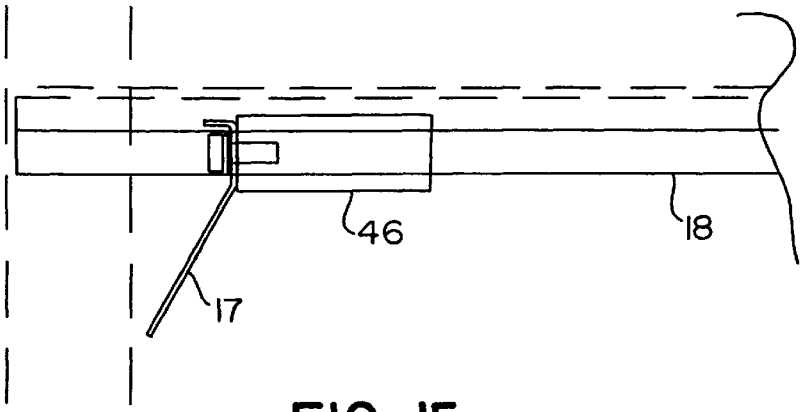
FIG. 15 is a top view of the side guide shown in FIG. 14.
Figure 14:
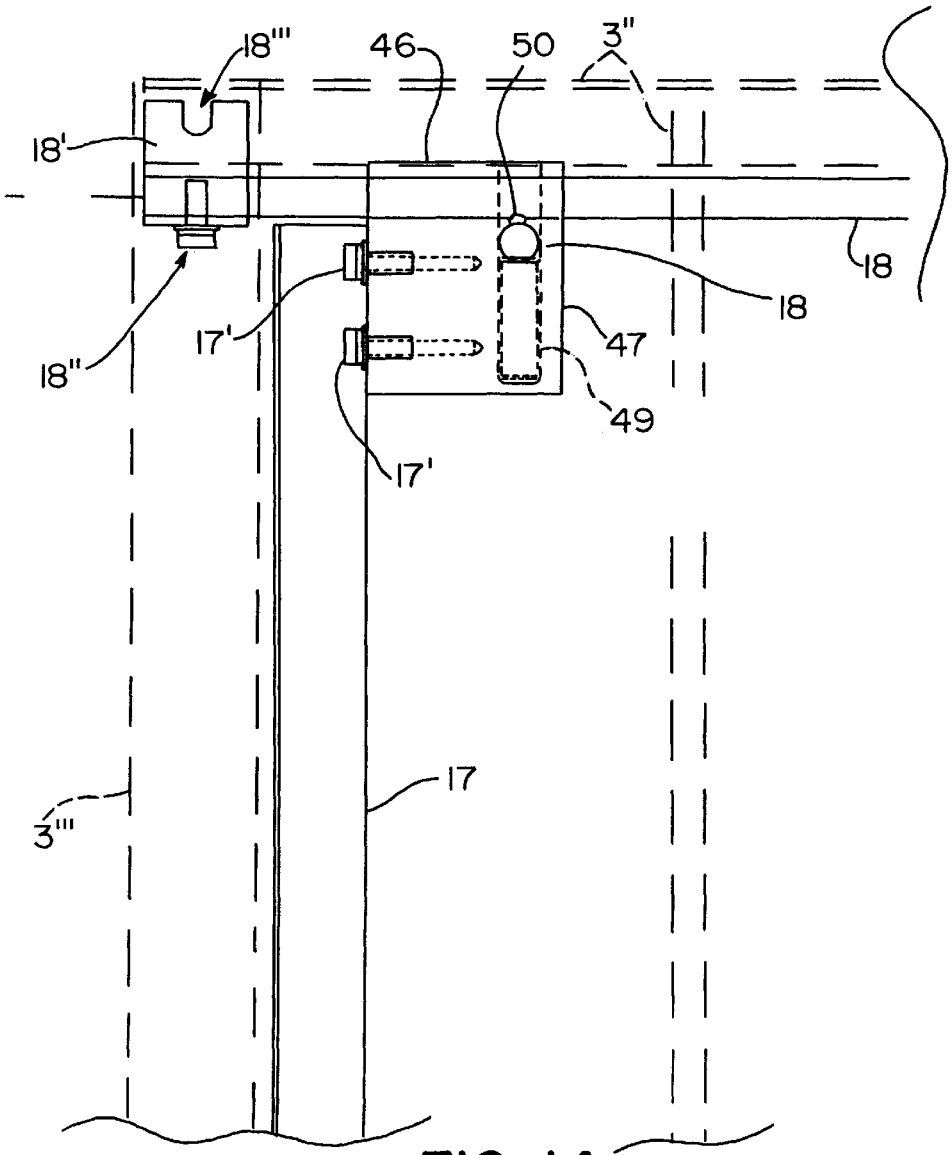
FIG. 14 is a front view of a side guide in an operative position.

A flat rod 18 is transversely connected across the vertical support 3 at a distance below the bottom of the housing which is slightly greater than the width of the side guides 17. As shown in FIG. 13, flat rod 18 is fixed to vertical structural support 3''' by a bracket 18'. FIG. 14 further shows screw 18" which attaches flat rod 18 to bracket 18'. Screw 18''' fixes bracket 18' to vertical structural support 3'''. An identical arrangement is provided at the opposite side of the stacker where the flat rod is fixed to the opposite side vertical structural support 3'''.

Side guides 17 are pivotally and adjustably fixed near opposite ends of flat rod 18. As shown in FIG. 10, side guides 17 are preferably wing-shaped along the width dimension, where a lower portion of each guide **17*a* is closer to the continuous form paper edge than a higher portion 17*b***. This configuration provides a "funneling effect" to guide and channel the continuous form paper at the top of the side guides, toward the more precise width defined by the lower portions of the side guides.

The flat rod 18 is fixed to the vertical support assembly by a pair of brackets 18' in an orientation such that the flat rod 18 is flat on the bottom and front (i.e., facing away from the vertical support assembly 3) sides thereof. Each of the side guides 17 includes a collar 46 having a ball detent assembly 47, as shown in FIG. 14. The ball detent assembly 47 includes a spring loaded ball 48 which is biased by compression spring 49. Ball 48 is adapted to engage one of two detents 50 provided on the flat rod 18 to effectively fix the side guide in position with respect to the flat rod 18. When the ball 48 contacts the bottom detent 50, spring 49 biases ball 48 against the detent 50 to maintain the side guide in position. The side guide 17 is in its active guiding position, as shown in phantom lines in FIG. 5. When the ball contacts the side flat surface detent, the side guide 17 is in its inactive position (shown in solid lines in FIG. 5). Each side guide 17 is mounted to the respective detent assembly 47 by at least one and preferably two screws or studs 17'.

Thus, each of the side guides can be independently rotated to an inactive position to allow easy side access to the paper stack, for removal thereof or otherwise. Additionally, each of the side guides is laterally adjustable along flat rod 18. The guides 17 are frictionally positioned laterally along the flat rod 18 by collars 46 and can easily be manually repositioned by an operator, by simply grasping the collar and/or guide and sliding it to a desired position using a moderate manual force.

Figure 3:
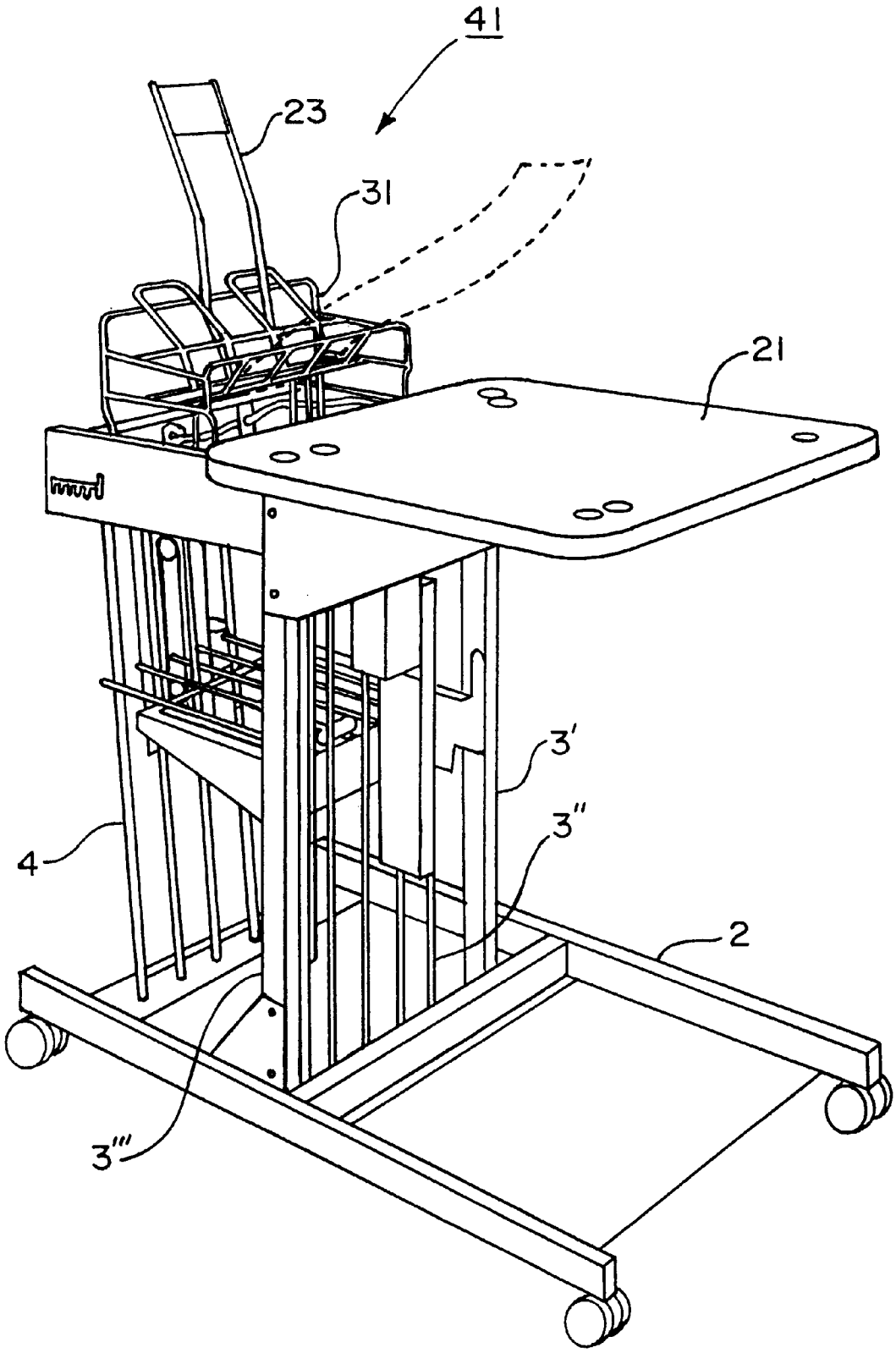
FIG. 3 is a perspective view of a second embodiment of the active stacker system according to the present invention.

FIG. 3 shows an alternative embodiment of the present invention. Rather than using the drive roller mechanism and pressure roller arrangement described with respect to the first embodiment, this embodiment 41 employs a top wire guide 31 which channels the continuous form paper into the feed path of the stacker system. Additionally, upper guide 23 may be pivotally mounted to the top wire guide. Upper guide 23 is pivotable toward the associated printer and is adapted to rest upon the body of the associated printer during use. This position is shown in phantom in FIG. 3. The continuous form paper outputted from the printer travels under the upper guide 23 and is fed down into the top wire guide 31. The upper guide can be easily pivoted away from the printer at any time, to the position shown in solid lines in FIG. 3, to allow access to the printer.

Figure 4:
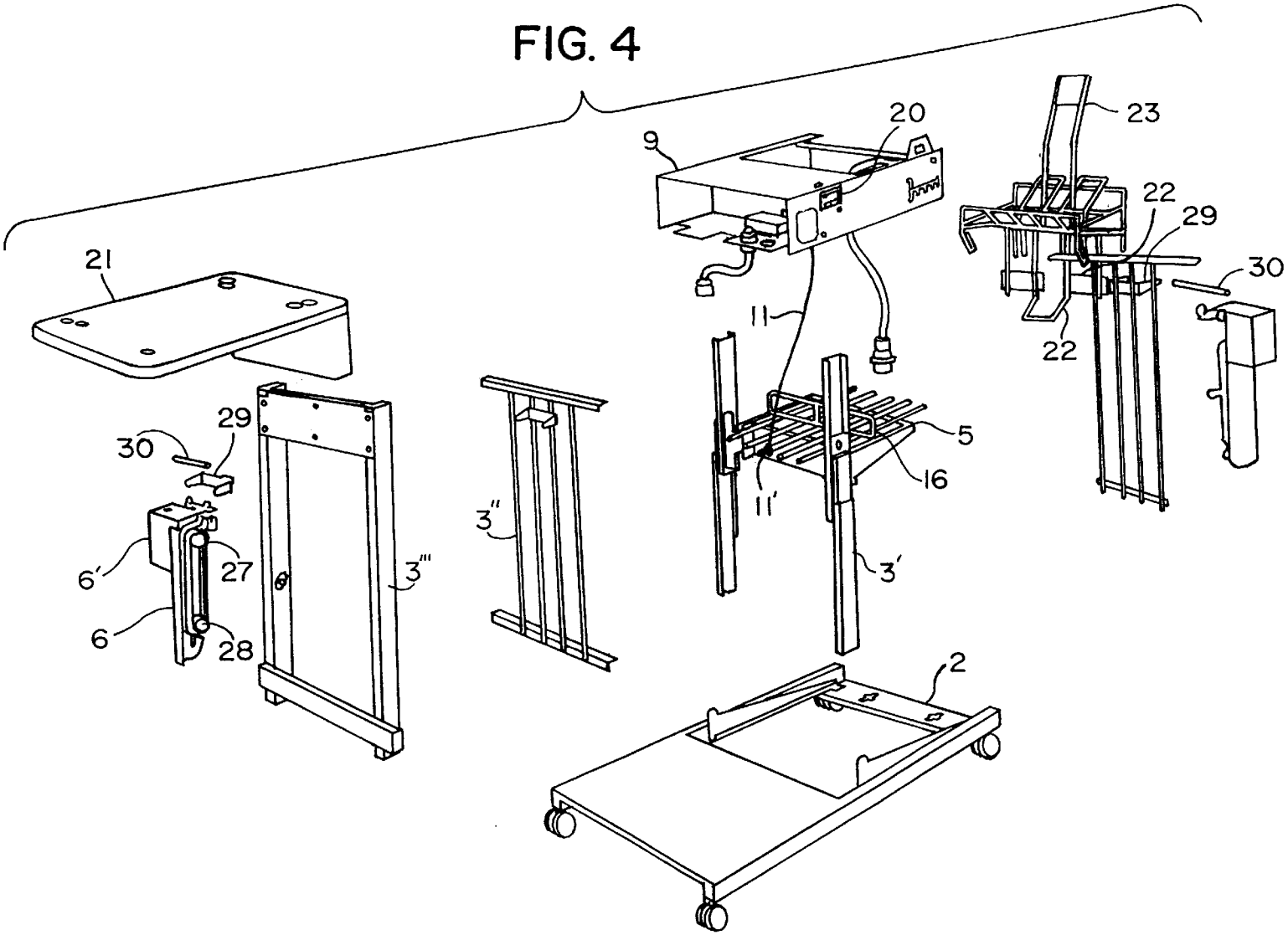
FIG. 4 is an exploded view of the embodiment shown in FIG. 3.
Figure 9:
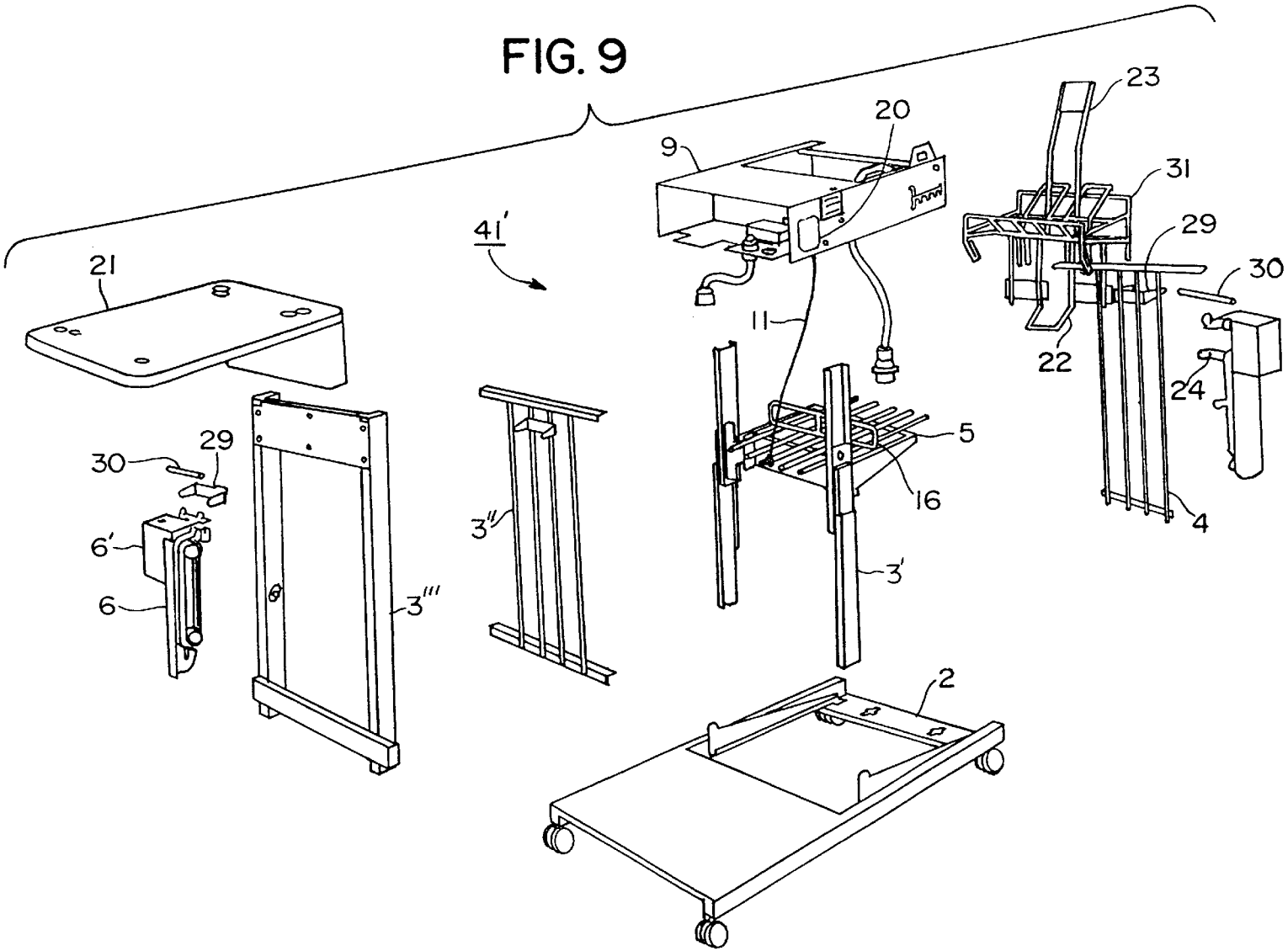
FIG. 9 is a variation of the embodiment shown in FIG. 3.

Additionally, the top wire guide preferably (but not necessarily) includes a pair of swinging arms 22 which extend downwardly therefrom, as shown in FIGS. 4 and 9. Swinging arms have a stabilizing effect upon the tendency of the continuous form paper to swing back and forth and thereby assist in directing the paper toward the center of the horizontal support 5. It is further noted that swinging arms may also be optionally employed in the first described embodiment. Once the continuous form paper passes beneath the top wire guide 31, the operation of the stacking system is the same as described previously in the first embodiment.

The operation of the active stacking system according to the present invention as shown in FIG. 1 is as follows: Initially, a printer is placed upon the second horizontal support 21. The operator adjusts the length of the area which will accept the stack on the horizontal support 5, by adjusting the positioning of the second vertical support assembly 4 to correspond with the page length of the continuous form paper to be used, as described above. The operator further positions the side guides to correspond to the width of the continuous form paper to be used, by grasping the collar and/or guide and sliding it to a desired position using a moderate manual force. If not already in their active positions, the operator rotates the side guides into their respective active positions.

Next, the continuous form paper is fed out of the printer and threaded through wire guide 14 and gap 35. The operator next pivots guide 14 so that pressure roller 15 presses against the drive roller 12 to form a nip 36 with the continuous form paper passing therethrough. The motors of the drive mechanism and the finger drive assemblies are then energized, either by manually actuating a power switch prior to printing, or simultaneously with a print operation via a relay to be described below.

Upon commencement of printing, the printer feeds continuous form paper to the stacker. The drive mechanism 12 and pressure roller 15 together pull the paper from the printer as it is fed. Although the drive mechanism and pressure roller run at a faster drive speed than the output speed of the printer, the drive roller and pressure roller are allowed to slip on the paper so that the feed speed of the paper is controller by the printer.

The drive roller and pressure roller (and optionally, swinging arms) direct the leading edge of the continuous form paper toward the center of the stacking area on the substantially horizontal support assembly 5. Refolding of the continuous form paper into its original stacking orientation is accomplished by hand, by the operator. Thereafter, the fingers of the finger drive assemblies contact the continuous form paper and apply downward force to the sheets to encourage them to refold into their original orientation.

Figure 8:
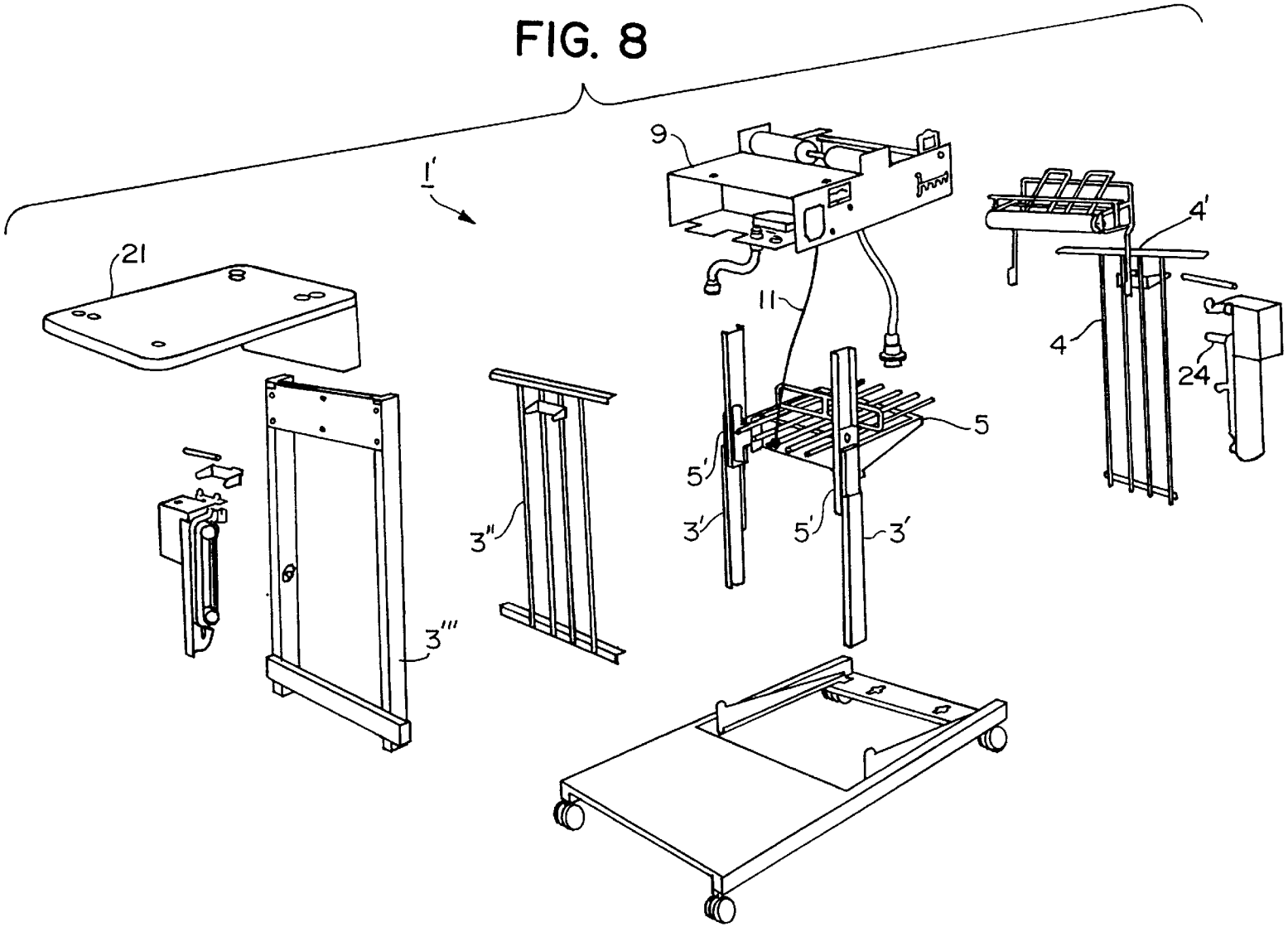
FIG. 8 is a variation of the embodiment shown in FIG. 1.

Respective variations of the embodiments shown in FIGS. 1 and 3 are shown in FIGS. 8 and 9. In these variations, an angular drive assembly 24 is provided to extend angularly from at least one of the finger drives into the path of the continuous form paper. The angular drive is driven by the finger drive (via the finger drive motor) to contact the continuous form paper and pull the continuous form paper toward the finger drive. The preferred variation is an O-ring type drive extending from the finger drive which is mounted on vertical support 3.

As shown in more detail in FIG. 12, angular drive assembly 24 extends inwardly from the finger drive assembly 6, in the direction of the horizontal assembly 5 (shown in phantom). A first pulley 59 of the angular drive assembly is mounted coaxially with pulley 57 and driven in conjunction therewith by motor 6'. A second pulley 60 is supported upwardly and inwardly of pulley 59 by adjustable support 61. Adjustable support 61 includes a radial groove 62 though which the adjustable support 61 is mounted to the finger drive assembly 6. Thus, the adjustable support can be infinitely variably adjusted between minimum and maximum positions shown in FIG. 12. The minimum position 60' is used for very stiff papers, e.g. tag stock; whereas the maximum position is used for thin paper. An O-ring belt 63 is received around pulleys 59 and 60.

FIG. 6 schematically shows a relay 19 which is provided for interconnecting an associated printer with at least one (preferably all three) of the disclosed motors of the stacking system. When the printer is in operation and outputting printed material on the continuous form paper, the printer outputs a signal which activates relay 19. Relay 19 in turn activates the one or more motors of the stacking system, so that the stacking system runs only when the printer is actually outputting printed sheets. Further discussion of the arrangement and function of such a relay arrangement is disclosed in Negishi, U.S. Pat. No. 5,425,694, which is hereby incorporated by reference in its entirety. Alternatively, FIG. 4 shows an embodiment in which a power switch 20 is provided on the stacking system, wherein the stacking system is manually activated and deactivated by the operator.

Although the invention has been described with reference to particular means, materials and embodiments, it is to be understood that the invention is not limited to the particulars disclosed and extends to all equivalents within the scope of the claims.

What is claimed is:

1. An active stacking system for continuous form paper comprising:

first and second generally vertical support assemblies;

a generally horizontal support assembly between said first and second generally vertical support assemblies for stacking the continuous form paper thereon, said generally horizontal assembly being vertically movable through a predetermined movement range as the continuous form paper is stacked thereon;

a housing mounted above said generally horizontal support assembly; and two finger drive assemblies that contact edges of the continuous form paper and pack the same into a substantially uniform stack, each extending in a vertical direction over at least the predetermined movement range of said generally horizontal support assembly, a first one of said two finger drive assemblies being pivotally mounted from a top portion thereof to said first generally vertical support assembly beneath said housing, and a second one of said two finger drive assemblies being pivotally mounted from a top portion thereof to said second generally vertical support assembly toward an outer side of said housing, each of said two finger drive assemblies being pivotable outwardly from said generally horizontal support assembly, to allow access unobstructed by any portion of said active stacking system to both edge sides of said continuous form paper on said generally horizontal support assembly.

2. The active stacking system according to claim 1, wherein each of said two finger drive assemblies further comprises:

a continuous belt rotatably driven by a corresponding one of said two finger drive assemblies;

a motor for driving said said continuous belt and said corresponding one of said two finger drive assemblies; and fingers extending from said continuous belt and intermittently spaced therealong, for contacting edges of the continuous form paper and packing the same into a substantially uniform stack on said generally horizontal support assembly.

3. The active stacking system according to claim 1, further comprising:

a tensioning mechanism supported by said housing, for resiliently supporting said generally horizontal support assembly;

interconnecting means for interconnecting said tensioning mechanism and said generally horizontal support assembly;

wherein said generally horizontal support assembly moves vertically downward as weight of the continuous form paper is accumulated thereon, and said tensioning mechanism maintains positioning of said generally horizontal support assembly so as to maintain a top of the paper stack in a substantially constant vertical position.

4. The active stacking system according to claim 3, wherein said tensioning mechanism comprises a torsion spring, and said interconnecting means comprises a cable, said torsion spring having a predetermined spring constant to apply tension to said cable and said generally horizontal support assembly, such that a distance that said generally horizontal support assembly moves in a vertically downward direction is substantially equal to a height of the paper stack that accumulates on said generally horizontal support assembly.

5. The active stacking system according to claim 1, further comprising at least one side guide pivotally mounted to one of said first and second generally vertical support assemblies, wherein said at least one side guide is pivotable between an active position, in which said at least one side guide maintains alignment of a side edge of the paper as it stacks upon said generally horizontal support assembly, and an inactive position, in which said at least one side guide is pivoted away from said active position to allow side access to the stacked paper.

6. The active stacking system according to claim 1, wherein a pressure roller is mounted to a guide having a contact area that guides the continuous form paper towards a drive roller mechanism.

7. The active stacking system according to claim 1, further comprising:

a drive roller mechanism mounted transversely on said housing;

a pressure roller which is pivotally mounted on said housing, said pressure roller being pivotable towards said drive roller mechanism to form a nip with said drive roller mechanism for feeding the continuous form paper toward said generally horizontal support assembly, said drive roller mechanism being driven by a first motor to rotate said drive roller at a first predetermined speed faster than that at which the continuous form paper is accepted in said nip, and said two finger drive assemblies being driven by at least one second motor to pack said contact edges at a second predetermined speed slower than said first predetermined speed.

8. An active stacking system for continuous form paper comprising:

a base for supporting the system;

first and second generally vertical support assemblies extending from said base and serving as end guides for forming a stack of the continuous form paper;

a housing mounted above said first and second generally vertical support assemblies;

a generally horizontal support assembly extending between said first and second generally vertical support assemblies for stacking the continuous form paper thereon, said generally horizontal support assembly mounted to said first generally vertical support assembly for vertical movement with respect thereto;

a finger drive assembly mounted to one of said first and second generally vertical support assemblies and extending in a generally vertical direction therealong, said finger drive assembly comprising movable fingers for contacting edges of the continuous form paper and packing the same into a substantially uniform stack;

a drive roller mechanism mounted transversely on said housing;

a pressure roller which forms a nip with said drive roller mechanism for feeding the continuous form paper toward said generally horizontal support assembly, said pressure roller being pivotally mounted on said housing so as to be pivotable toward said drive roller mechanism to provide said nip; and a pair of side guides positioned below said housing, said drive roller mechanism, and said pressure roller, for guiding side edges of the continuous form paper into a stack on said generally horizontal support assembly, each side guide of said pair of side guides being pivotally supported on one of said first and second generally vertical support assemblies to pivot parallel to said side edges of said stack of said continuous form paper, each side guide of said pair of side guides being pivotable between an active position in which said each side guide maintains alignment of the side edges of the continuous form paper and an inactive position, in which said side guide is pivoted away from said active position to allow side access to the stacked paper;

wherein said pair of side guides and at least one of said end guides are each orthogonally adjustable with respect to said generally horizontal support assembly, to accommodate various sheet sizes of continuous form paper.

9. The active stacking system according to claim 8, further comprising:

a tensioning mechanism supported by said housing, for resiliently supporting said generally horizontal support assembly;

interconnecting means for interconnecting said tensioning mechanism and said generally horizontal support assembly;

wherein said generally horizontal support assembly moves vertically downward as weight of the continuous form paper is accumulated thereon, and said tensioning mechanism maintains positioning of said generally horizontal support assembly so as to maintain a top of the paper stack in a substantially constant vertical position.

10. The active stacking system according to claim 9, wherein said tensioning mechanism comprises a torsion spring, and said interconnecting means comprises a cable, said torsion spring having a predetermined spring constant to apply tension to said cable and said generally horizontal support assembly, such that a distance that said generally horizontal support assembly moves in a vertically downward direction is substantially equal to a height of the paper stack that accumulates on said generally horizontal support assembly.

11. An active stacking system for continuous form paper comprising:

a base for supporting the system;

first and second generally vertical support assemblies extending from said base;

a housing mounted above said first and second generally vertical support assemblies;

a generally horizontal support assembly extending between said first and second generally vertical support assemblies for stacking the continuous form paper thereon, said generally horizontal support assembly mounted to said first generally vertical support assembly for vertical movement with respect thereto;

a drive roller mechanism, being driven by a drive roller motor, mounted transversely on said housing;

a guide pivotally mounted to said housing and having a contact area that redirects the continuous form paper and guides the continuous form paper towards said drive roller mechanism, said guide being pivotable toward and away from said drive roller mechanism, said drive roller mechanism in combination with said guide directing the continuous form paper toward said generally horizontal support assembly when said guide is pivoted toward said drive roller mechanism, said drive roller mechanism driving said continuous form paper toward a center of said generally horizontal guide assembly;

a first finger drive assembly pivotally mounted to at least one of said first and second generally vertical support assemblies and extending in a vertical direction therealong;

a first continuous belt rotatably driven by said first finger drive assembly;

a first finger drive mechanism motor for driving said first finger drive assembly and said first continuous belt; and first fingers extending from said first continuous belt and intermittently spaced therealong, for contacting edges of the continuous form paper and packing the same into a substantially uniform stack on said generally horizontal support assembly.

12. The active stacking system according to claim 11, further comprising:

a tensioning mechanism supported by said housing, for resiliently supporting said generally horizontal support assembly; and interconnecting means for interconnecting said tensioning mechanism and said generally horizontal support assembly;

wherein said generally horizontal support assembly moves vertically downward as weight of the continuous form paper is accumulated thereon, and said tensioning mechanism maintains positioning of said generally horizontal support assembly so as to maintain a top of the paper stack in a substantially constant vertical position.

13. The active stacking system according to claim 12, wherein said tensioning mechanism comprises a torsion spring and said interconnecting means comprises a cable.

14. The active stacking system according to claim 13, wherein said cable is connected to said torsion spring at one end of said cable, and connected to said generally horizontal support assembly at another end of said cable.

15. The active stacking system according to claim 13, wherein said torsion spring has a predetermined spring constant to apply tension to said cable and said generally horizontal support assembly, such that a distance that said generally horizontal support assembly moves in a vertically downward direction is substantially equal to a height of the paper stack that accumulates on said generally horizontal support assembly.

16. The active stacking system according to claim 11, further comprising:

a second finger drive assembly pivotally mounted to the other of said first and second vertical support assemblies and extending in a substantially vertical direction therealong;

a second continuous belt rotatably driven by said second finger drive assembly; and second fingers extending from said second continuous belt and intermittently spaced therealong, for contacting edges of the continuous form paper and packing the same into a substantially uniform stack;

wherein said second finger drive assembly is pivotable away from said other of said first and second generally vertical support assemblies, to allow access to the paper on said generally horizontal support assembly.

17. The active stacking system according to claim 16, further comprising:

a second finger drive mechanism motor for driving said second finger drive assembly and said second continuous belt.

18. The active stacking system according to claim 11, further comprising:

a drive roller motor connected to said drive roller mechanism for driving said drive roller mechanism; and a pressure roller mounted transversely on said guide;

wherein, upon pivoting said guide toward said drive roller mechanism, said pressure roller applies pressure to said drive roller mechanism to provide a nip through which the continuous paper is driven.

19. The active stacking system according to claim 18, wherein said drive roller mechanism comprises two axially aligned rollers, each of said two axially aligned rollers being driven by said drive roller motor.

20. The active stacking system according to claim 19, wherein said generally horizontal support assembly further comprises a rib mounted transversely on a top side and centrally on said generally horizontal support assembly to raise a middle portion of the stacked paper to compensate for a tendency of the paper to stack more compactly in the middle of the stack than at the edges.

21. The active stacking system according to claim 18, further comprising:

a relay mounted in said housing and connected to said first finger drive mechanism motor and said drive roller motor for supplying power to said first finger drive mechanism motor and said drive roller motor when said relay is connected to a printer, wherein the printer activates said relay to activate said first finger drive mechanism motor and said drive roller motor during printing.

22. The active stacking system according to claim 11, wherein said generally horizontal support assembly further comprises a rib mounted longitudinally on a top side and centrally on said generally horizontal support assembly to raise a middle portion of the stacked paper to compensate for a tendency of the paper to stack more compactly in the middle of the stack than at the edges.

23. The active stacking system according to claim 11, further comprising:

at least one side guide pivotally mounted to one of said first and second generally vertical support assemblies, wherein said at least one side guide is pivotable between an active position, in which said at least one side guide maintains alignment of a side edge of the paper as it stacks upon said generally horizontal support assembly, and an inactive position, in which said at least one side guide is pivoted away from said active position to allow side access to the stacked paper.

24. The active stacking system according to claim 23, wherein said at least one side guide comprises:

a rod mounted transversely on said one of said first and second generally vertical support assemblies; and first and second side guides pivotally mounted near opposite ends of said rod, wherein said first and second side guides are each pivotable between said active and inactive positions.

25. The active stacking system according to claim 11, wherein said first generally vertical support assembly comprises:

a pair of generally vertically extending opposed tracks; and generally vertically extending wire guides positioned between said generally vertically extending opposed tracks;

wherein said generally horizontal support assembly comprises a pair of rolling supports for rolling within said pair of generally vertically extending opposed tracks for generally vertical movement of said generally horizontal support assembly.

26. The active stacking system according to claim 11, wherein said second generally vertical support assembly comprises:

generally vertically extending wire guides adjustably positioned with respect to said first generally vertical support assembly to accommodate different sheet lengths of the continuous form paper.

27. The active stacking system according to claim 26, wherein said generally horizontal support assembly comprises:

generally horizontally extending wire guides which extend between said generally vertically extending wire guides of said second vertical support assembly to allow said adjustable positioning of said first vertical support therealong.

28. The active stacking system according to claim 11, further comprising:

a relay connected to said first finger drive mechanism motor for supplying power to said first finger drive mechanism motor when said relay is connected to a printer, wherein the printer activates said relay to activate said first finger drive mechanism motor during printing.

29. The active stacking system according to claim 11, further comprising:

a power switch for activating the active stacking system independently of a printer.

30. The active stacking system according to claim 11, further comprising:

another generally horizontal support assembly mounted atop said first generally vertical support assembly and extending generally horizontally away from said second generally vertical support assembly, wherein said another generally horizontal support assembly is adapted to support a printer, such that paper output from the printer is fed into the active stacking system.

31. The active stacking system according to claim 11, further comprising:

a pair of swinging arms pivotally mounted to swing beneath said housing, wherein the continuous form paper is guided between said pair of swinging arms, said swinging arms directing the continuous form paper toward a central portion of said generally horizontal support assembly.

32. The active stacking system according to claim 11, further comprising:

an upper guide pivotally mounted to said housing, said upper guide adapted to extend above a top surface of an associated printer, said upper guide being pivotable toward a printer to rest thereupon, and away from a printer to allow access to the printer.

33. The active stacking system according to claim 11, further comprising:

a first angular drive assembly extending angularly from said first finger drive assembly into a path of the continuous form paper, said first angular drive assembly being driven by said first finger drive assembly to contact the continuous form paper and pull the continuous form paper toward said first finger drive assembly.

34. The active stacking system according to claim 33, wherein said first angular drive assembly comprises an adjustable support that is mounted to said first finger drive assembly to adjust an angular position that said first angular drive assembly extends from said first finger drive assembly.

35. The active stacking system according to claim 11, wherein said first finger drive assembly is pivotable outwardly from said one of said first and second generally vertical support assemblies, to allow access to the paper on said generally horizontal support assembly.

36. The active stacking system according to claim 11, said drive roller mechanism being driven by said drive roller motor to rotate said drive roller mechanism at a first predetermined speed faster than that at which the continuous form paper is accepted in a nip formed between the drive roller mechanism and the guide, and said first finger drive assembly being driven by said first finger assembly motor to pack said contact edges at a second predetermined speed slower than said first predetermined speed.

37. An active stacking system for continuous form paper comprising:

a base for supporting the system;

first and second generally vertical support assemblies extending from said base;

a housing mounted above said first and second generally vertical support assemblies;

a generally horizontal support assembly extending between said first and second generally vertical support assemblies for stacking the continuous form paper thereon, said generally horizontal support assembly mounted to said first generally vertical support assembly for vertical movement with respect thereto;

a first finger drive assembly mounted to one of said first and second generally vertical support assemblies and extending in a generally vertical direction therealong, said first finger drive assembly comprising movable first fingers extending from a continuous belt driven by a first drive pulley driven by a first finger drive assembly motor, said first finger drive assembly for contacting edges of the continuous form paper and packing the same into a substantially uniform stack on said generally horizontal support assembly;

at least one angular drive assembly extending angularly from said first finger drive assembly into a path of the continuous form paper between said first and second generally vertical support assemblies, said at least one angular drive assembly comprising a continuous belt extending from a second drive pulley coaxial with said first drive pulley and driven together with said first drive pulley to contact the continuous form paper and pull the continuous form paper toward said first finger drive assembly;

an adjustable angular drive assembly support for adjusting an angular position at which said at least one angular drive assembly extends from said second drive pulley and said first finger drive assembly, a drive roller mechanism mounted transversely on said housing;

a drive roller motor connected to said drive roller mechanism for driving said drive roller mechanism independently of said first finger drive assembly;

a guide pivotally mounted to said housing and having a contact area that guides the continuous form paper towards said drive roller mechanism, said guide being pivotable toward and away from said drive roller mechanism; and a pressure roller mounted transversely on said guide;

wherein, upon pivoting said guide toward said drive roller mechanism, said pressure roller applies pressure to said drive roller mechanism to provide a nip through which the continuous form paper is driven and directed toward said generally horizontal support assembly.

38. The active stacking system according to claim 37, further comprising:

a second finger drive assembly pivotally mounted to the other of said first and second generally vertical support assemblies and extending in a generally vertical direction therealong;

a second continuous belt rotatably driven by said second finger drive assembly; a second finger drive mechanism motor for independently driving said second finger drive assembly and said second continuous belt; and second fingers extending from said second continuous belt and intermittently spaced therealong, for contacting edges of the continuous form paper and packing the same into a substantially uniform stack;

wherein at least one of said first finger drive assembly and said second finger drive assembly is pivotable outwardly from one of said first and second generally vertical support assemblies, to allow access to the paper on said horizontal support.

39. The active stacking system according to claim 37, further comprising:

a tensioning mechanism supported by said housing, for resiliently supporting said generally horizontal support assembly; and interconnecting means for interconnecting said tensioning mechanism and said generally horizontal support assembly;

wherein said generally horizontal support assembly moves generally vertically downward as weight of the continuous form paper is accumulated thereon, and said tensioning mechanism maintains positioning of said generally horizontal support assembly so as to maintain a top of the paper stack in a substantially constant vertical position.

40. The active stacking system according to claim 39, wherein said tensioning mechanism comprises a torsion spring and said interconnecting means comprises a cable, said cable being connected to said torsion spring at one end of said cable, and connected to said generally horizontal support assembly at another end of said cable.

41. The active stacking system according to claim 40, wherein said torsion spring has a predetermined spring constant to apply tension to said cable and said generally horizontal support assembly, such that a distance that said generally horizontal support assembly moves in a vertically downward direction is substantially equal to a height of the paper stack that accumulates on said generally horizontal support assembly.

42. The active stacking system according to claim 37, further comprising:

a rib mounted on a top side and centrally of said generally horizontal support assembly to raise a middle portion of the stacked paper to compensate for a tendency of the paper to stack more compactly in the middle of the stack than at the edges;

a rod mounted transversely on said one of said first and second generally vertical support assemblies; and first and second side guides pivotally mounted near opposite ends of said rod, wherein said first and second side guides are each pivotable between an active position, in which each said side guide maintains alignment of a side edge of the paper as it stacks upon said generally horizontal support assembly, and an inactive position, in which each said side guide is pivoted away from said active position to allow side access to the stacked paper.

43. The active stacking system according to claim 37, wherein said first generally vertical support assembly comprises a pair of generally vertically extending opposed tracks and generally vertically extending wire guides positioned between said generally vertically extending opposed tracks;

wherein said generally horizontal support assembly comprises a pair of rolling supports for rolling within said pair of generally vertically extending opposed tracks for generally vertical movement of said generally horizontal support assembly;

wherein said second generally vertical support assembly comprises generally vertically extending wire guides adjustably positioned with respect to said first generally vertical support assembly to accommodate different sheet lengths of the continuous form paper; and wherein said generally horizontal support assembly further comprises generally horizontally extending wire guides which extend between said generally vertically extending wire guides of said second generally vertical support assembly to allow said adjustable positioning of said second generally vertical support assembly therealong.

44. The active stacking system according to claim 37, further comprising:

a stop mounted to a side of said first finger drive assembly, wherein said stop abuts said one of said first and second generally vertical support assemblies to position said first finger drive assembly in said generally vertical direction therealong.

45. The active stacking system according to claim 37, further comprising at least one side guide pivotally mounted to one of said first and second generally vertical support assemblies, wherein said at least one side guide is pivotable between an active position, in which said at least one side guide maintains alignment of a side edge of the paper as it stacks upon said generally horizontal support assembly, and an inactive position, in which said at least one side guide is pivoted away from said active position to allow side access to the stacked paper.

46. The active stacking system according to claim 45, further comprising a rod mounted transversely on said one of said first and second generally vertical support assemblies, and first and second side guides pivotally mounted near opposite ends of said rod, wherein said first and second side guides are each pivotable between said active and inactive positions.

47. The active stacking system according to claim 37, further comprising a pair of swinging arms pivotally mounted to swing beneath said housing, wherein the continuous form paper is guided between said pair of swinging arms, said swinging arms directing the continuous form paper toward a central portion of said generally horizontal support assembly.

48. The active stacking system according to claim 37, said drive roller mechanism being driven by said drive roller motor to rotate said drive roller mechanism at a first predetermined speed faster than that at which the continuous form paper is accepted in said nip, and said first finger drive assembly being driven by said first finger drive assembly motor to pack said contact edges at a second predetermined speed slower than said first predetermined speed.

* * * * *